US005341872A

United States Patent [19]

Mercurio

[11] Patent Number: 5,341,872

[45] Date of Patent: Aug. 30, 1994

[54] HEAT EXCHANGER AND MANIFOLD THEREFOR, AND METHOD OF ASSEMBLY THEREOF

[75] Inventor: Carlo V. Mercurio, Clinton Township, Macomb County, Mich.

[73] Assignee: Valeo Engine Cooling Inc., Rochester Hills, Mich.

[21] Appl. No.: 64,762

[22] Filed: May 19, 1993

[51] Int. Cl.[5] ..... F28F 9/06

[52] U.S. Cl. ..... 165/173; 165/174

[58] Field of Search ..... 165/174, 176, 173; 29/890.052

[56] References Cited

U.S. PATENT DOCUMENTS

| | | | |
|---|---|---|---|
| 5,107,926 | 4/1992 | Calleson | 165/173 |
| 5,125,454 | 6/1992 | Creamer et al. | 165/173 |
| 5,183,107 | 2/1993 | Le Gauyer | 165/176 |
| 5,195,579 | 3/1993 | Buchanan | 165/173 X |

FOREIGN PATENT DOCUMENTS

| | | | |
|---|---|---|---|
| 1057148 | 5/1959 | Fed. Rep. of Germany | 165/176 |
| 1098530 | 2/1961 | Fed. Rep. of Germany | 165/176 |
| 56594 | 5/1981 | Japan | 165/173 |

*Primary Examiner*—John Rivell
*Assistant Examiner*—L. R. Leo
*Attorney, Agent, or Firm*—Morgan & Finnegan

[57] ABSTRACT

A heat exchanger manifold comprises a tubular manifold, and a plurality of heat exchange tubes connected thereto, the manifold comprising a header part in the form of an elongate member defining a plurality of apertures therein, into which end portions of heat exchanger tubes extend, and a tank part comprising an elongate member which is non-unitarily formed with said header part, and defines a tubular housing with said header part and is joined thereto at longtiduinal engagement surfaces, the said manifold further comprising a plurality of plate-shaped baffles, and an elongate locating rail fitted within said housing and supporting said baffles transversely in said tubular housing.

3 Claims, 4 Drawing Sheets

FIG. 4
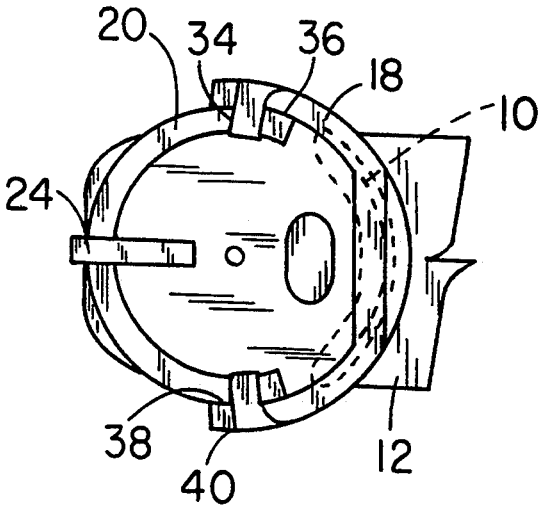
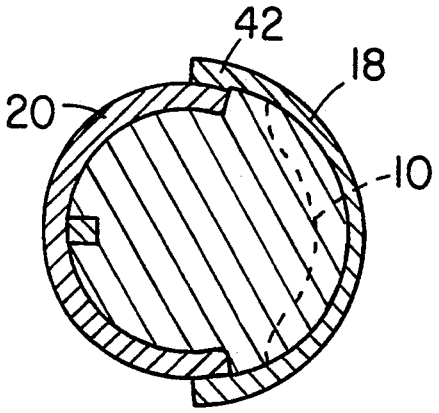
FIG. 5
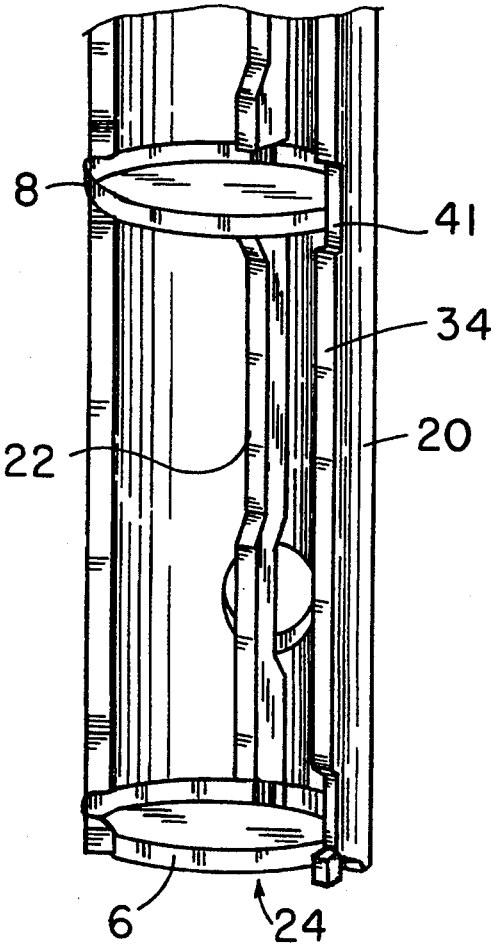
FIG. 3

HEAT EXCHANGER AND MANIFOLD THEREFOR, AND METHOD OF ASSEMBLY THEREOF

FIELD OF THE INVENTION

The present invention relates to a manifold for a heat exchanger and to a heat exchanger incorporating such a manifold and to a method of assembly thereof.

BACKGROUND OF THE INVENTION

Heat exchangers, such as are typically employed in air conditioning systems for example for automobiles, generally comprise a large number of heat exchange tubes which carry coolant fluid, connected to a manifold. The manifold is internally divided into a plurality of compartments including an inlet compartment to which a fluid inlet line is connected, an outlet compartment to which a fluid outlet line is connected, and a further intermediate compartment or compartments, so that a tortuous multi-pass path for coolant fluid is defined by the manifold and heat exchange tubes. Heat exchange occurs between the coolant fluid passing through the heat exchange tubes, and surrounding air.

Such internally divided manifolds are difficult to form and to assemble. Conventionally, the manifold comprises two-half shells in the form of a header part which is provided with apertures for the heat exchange tubes, and a tank part. These parts include internal walls cast, welded or brazed therein, and are connected together by, for example, brazing to form the complete manifold. Such an arrangement requires the parts to be formed with very high precision. If the walls are not very accurately positioned they may obscure or partially obscure openings in the manifold wall for the heat exchange tubes, restricting fluid flow or causing leaking reduces the effectiveness of heat transfer and functionality.

It is also known to provide a unitary tubular manifold, into which internal wall members are introduced and brazed in position. For example, it has been proposed to form additional slots in the manifold wall, through which internal baffles are introduced and then brazed in position. A drawback of this arrangement is that manufacture of the tubular wall is complicated by the need to provide precision slots. These slots also give rise to possible additional external leakage points.

Other arrangements require the precision forming of seats or locating surfaces on the inner surfaces of the manifold for the internal partitions or baffles.

It has also been proposed by the applicants to provide a unitary tubular manifold, and to provide the internal walls as well as end walls in the form of baffles which are held on a guide rail. On assembly, the baffles are first located on the guide rail which is subsequently introduced into the tubular manifold from one end thereof. This arrangement avoids the need for slots for the introduction of internal walls, or for the provision of seats or sealing surfaces on the internal surface of the tubular manifold housing. It has, however, been found to be difficult to introduce the assembly of guide rail and baffles if there are any casting irregularities in the form of flash or burr on the inside of the tubular manifold.

DISCUSSION OF THE INVENTION

An object of the invention is to provide a manifold and heat exchanger which overcomes the problems discussed above. According to a first aspect of the present invention there is provided a set of components for assembly to form a heat exchanger manifold, comprising:

a header part in the form of an elongate member defining a plurality of apertures for receiving end portions of heat exchange tubes;

a tank part comprising an elongate member adapted to cooperate with said header part to define therewith a tubular housing, and to be joined to thereto at longitudinal engagement surfaces of said tank and header parts;

a plurality of wall members dimensioned to fit transversely within said tubular housing; and an elongate locating rail adapted to be fitted to said tank or header part so as to extend within said tubular housing, and to support said wall members in said transverse relation within said tubular housing.

According to a further aspect of the invention there is provided a heat exchanger manifold comprising:

a tubular housing comprising a header part in the form of an elongate member defining a plurality of apertures therein at which end portions of heat exchange tubes are connectable, and a tank part comprising an elongate member which is non-unitarily formed with said header part, which cooperates to define a tubular housing with said header part and is joined thereto at longitudinal engagement surfaces of the tank and header parts;

a plurality of wall members dimensioned to fit transversely within said housing, and an elongate locating rail fitted within said tubular housing and supporting said wall members in said transverse relation within said tubular housing.

Forming a manifold housing which comprises non-unitary header and tank parts, wherein the internal walls for the housing are held on the locating rail fitted therebetween means that the internal walls can be positioned very acurately within the manifold housing without the need for additional locating means, seats, or seating surfaces on the inner walls of the housing.

Preferably, the locating rail is adapted to snap-fit onto the tank part, comprising at opposite ends thereof laterally extending feet having upturned end portions extending therefrom which snap-fit over the ends of the tank part. The ends of the tank part preferably define notches formed therein into which the feet are at least partly received. This allows the locating rail to be easily and accurately fitted on the tank part.

Preferably, the header part and tank parts both comprise elongate channel-shaped memebrs of generally semi-circular transverse cross-section, and the radius of the transverse section of the header part is greater than the radius of the transverse section of the tank part, whereby longitudinal edge regions of the tank part are received within the channel of the header part, forming overlapping regions which constitute engagement surfaces where the header part and tank part are in engagement. This arrangement ensures that there is a substantial region where the edges of the tank and header parts overlap, allowing a strong joint therebetween to be easily provided.

The difference in radius between the header part and tank part is preferably approximately equal to the wall thickness of the edge region of the tank part, although if the difference is slightly less, a degree of interference fit can be provided, assisting in providing a good joint therebetween.

Preferably, the opposite ends of the tank part define adjacent the longitudinal edge regions alignment notches, and opposite ends of the header part adjacent edge regions thereof are formed with tabs bent into the alignment notches. This arrangement ensures correct relative alignment prior to a final joining operation which involves brazing of the entire assembly in order to provide a pressure tight joint.

Longitudinal edge regions of the tank part may define recessed portions in which engagement surfaces of the wall members are located. This assists in ensuring that the wall members are correctly and stably positioned on the tank part.

Preferably, the locating rail defines locating slots therein, spaced along the rail, and the wall members comprise plate-like members each defining a slot which is received by a respective slot of the rail to support the wall members in said transverse relation within the tubular housing.

According to a further aspect of the invention there is provided a method of assembling a heat exchanger as described above, the method comprising the steps of:

a) fitting said wall members to said locating rail; and, subsequent to or prior to step (a);

b) fitting said locating rail to said tank part to form a tank sub-assembly;

c) introducing end portions of the heat exchange tubes into respective apertures on said header part, to form a header sub-assembly; and d) joining said header and tank sub-assemblies together, at said longitudinal engagement surfaces, said header part and tank part defining said tubular manifold housing.

This method allows-the heat exchanger to be assembled accurately and easily, and in particular allows the wall members, which are held on the locating rail, to be accurately positioned.

A further advantage is that should there be any irregularity in formation of the apertures in the header part (such as a constant small misalignment, or any irregularity due to a small twist in this component) then it is possible to very simply adapted the orientation or position of the wall members by appropriately adapting the locating rail.

Preferably, in step d) correct relative alignment is ensured by engaging alignment means provided on the header part and tank part. Subsequently, the header and tank sub-assemblies which are provided with a fusible metallic coating on at least the engagement surfaces of the tank or header part, and on inner surfaces thereof or on the wall members, are brazed in an oven to provide a pressure-tight joint therebetween.

BRIEF DESCRIPTION OF THE DRAWINGS

An embodiment of the invention is described, by way of example only, with reference to the following drawings in which:

FIG. 3 is a detailed view of an end region of a tank sub-assembly;

FIG. 4 is an end view (enlarged) in the direction of the arrow A of FIG. 1;

FIG. 5 is a cross-sectional view (enlarged) taken along the line B—B in FIG. 1.

DETAILED DESCRIPTION OF THE PREFERRED EMBODIMENT

Figure 1:
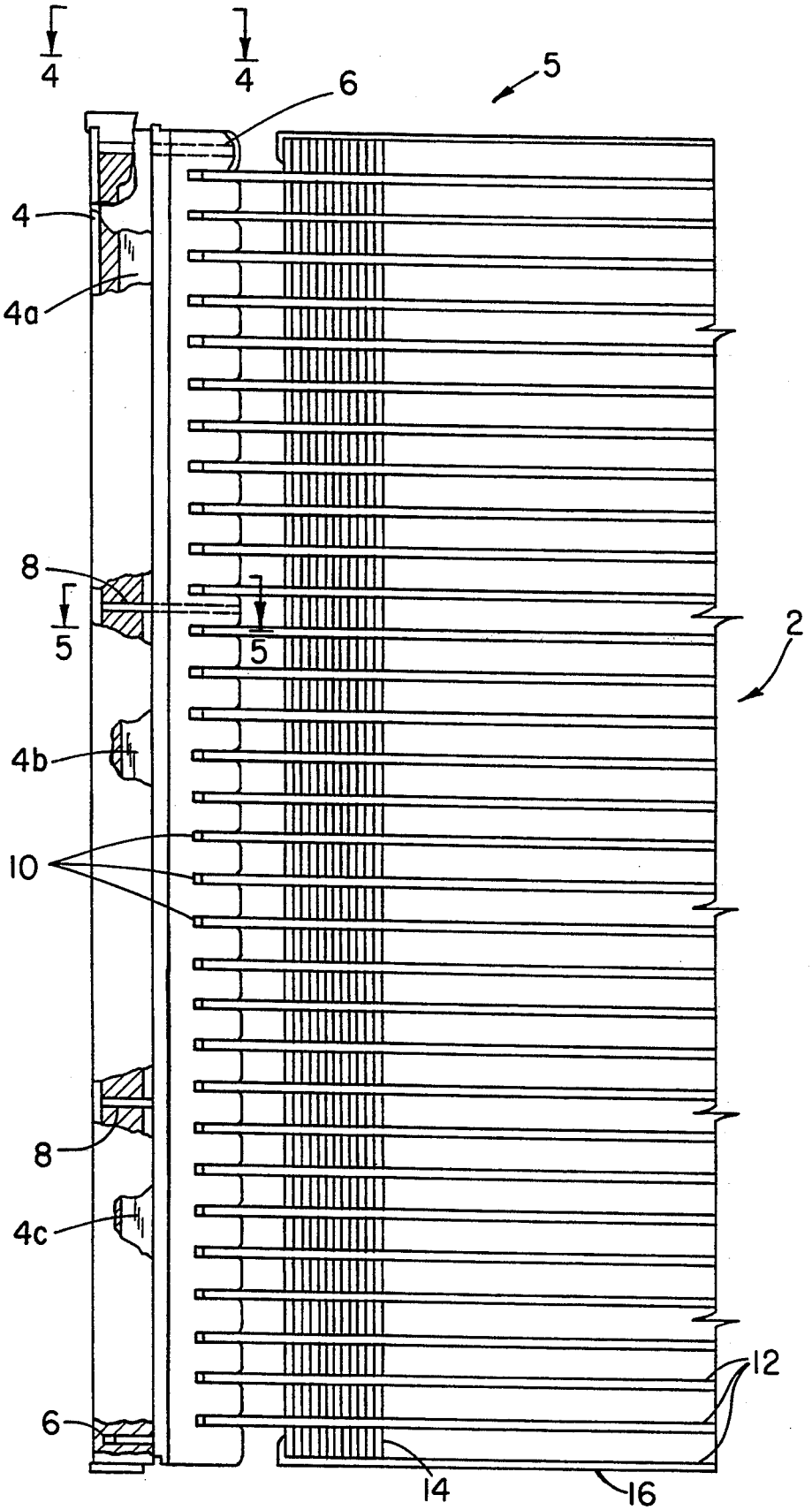
FIG. 1 shows a part of a heat exchanger with a manifold in accordance with the invention.

FIG. 1 shows part of a heat exchanger generally designated 2 for use for example as a condensor in an automobile air conditioning system. The heat exchanger 2 comprises a tubular fluid manifold 4 which is connected to a heat exchange core 5. The manifold 4 is in the form of tubular housing which is closed at opposite ends by means of transverse end baffles or walls 6 so as to define an interior space which is sub-divided by intermediate walls or baffles 8 which constitute internal partitions into a plurlaity of compartments 4*a*, 4*b* and 4*c*.

The tubular manifold 4 is formed with a plurality of elongate apertures 10. The heat exchange core 5 comprises a plurality of heat exchange tubes 12 extending into each of the apertures 10, with an open end of each heat exchange tube located within the interior of the manifold, (as can be seen in the right hand portion of the view of the manifold 4 in FIG. 1 cut away to show the manifold interior) so that the tubes 12 and compartments 4*a*, 4*b*, 4*c* are in fluid communication. The heat exchange tubes 12 are elongate in cross-section (as best seen in FIG. 4) and extend parallel to each other in a direction also perpendicular to the manifold axis. These tubes 12 are formed in a conventional manner by extrusion. The heat exchange core 5 is connected at its side opposite to the manifold 4 to a further manifold (not shown) which may be of similar form to the manifold 4. The arrangement of internally divided manifolds is such as to define a tortuous multi-pass pathway for coolant fluid (typically a refrigerant) between the compartment 4*a* which is an inlet compartment, and compartment 4*c* which is an outlet compartment. Inserts 14 comprising bands of sheet metal which are curved or folded into a corrugated or wave-like form are located in the spaces between the heat exchange tubes 12, or between the tubes 12 and an end plate 16 so as to be in thermal contact with the tubes. These serve to increase the effective surface area of the heat exchange surface.

Figure 2:
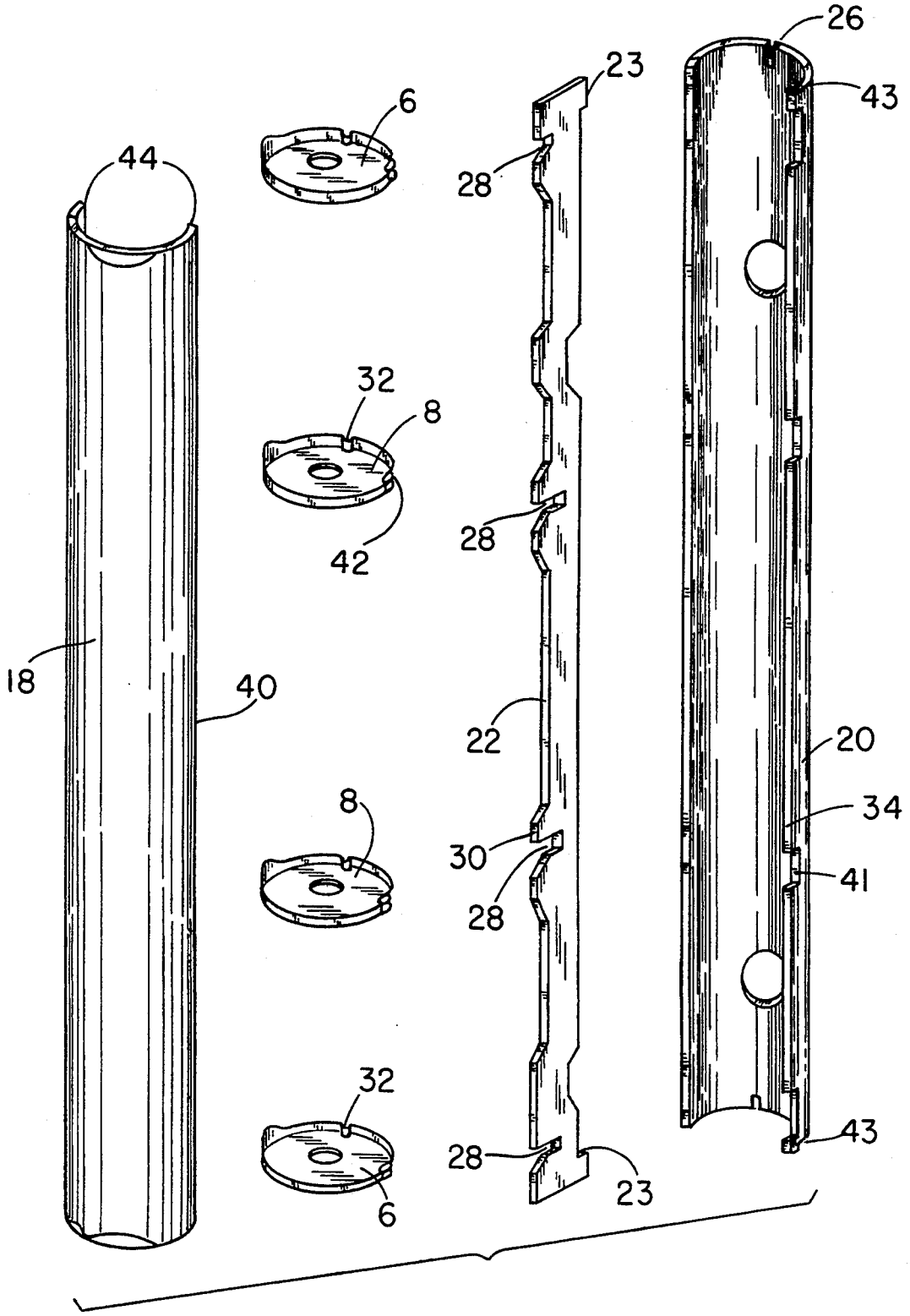
FIG. 2 is an exploded view of a manifold in accordance with the invention.

The manifold 4 comprises, as best seen in the exploded view of FIG. 2, a header part 18 and tank part 20 which together define the tubular manifold housing. The header part 18 is an elongate, generally channel-shaped member of transverse cross-section of generally semi-circular annular shape. The header part 18 is provided with the apertures 10 into which the heat exchange tubes 12 (omitted from FIG. 2) extend. The tank part 20 is also of elongate channel-shaped form having a transverse cross-section of generally semi-circular annular form. As is discussed in more detail below, the tank part 20 is of slightly smaller radius (in transverse section) than the header part 18.

Figure 6:
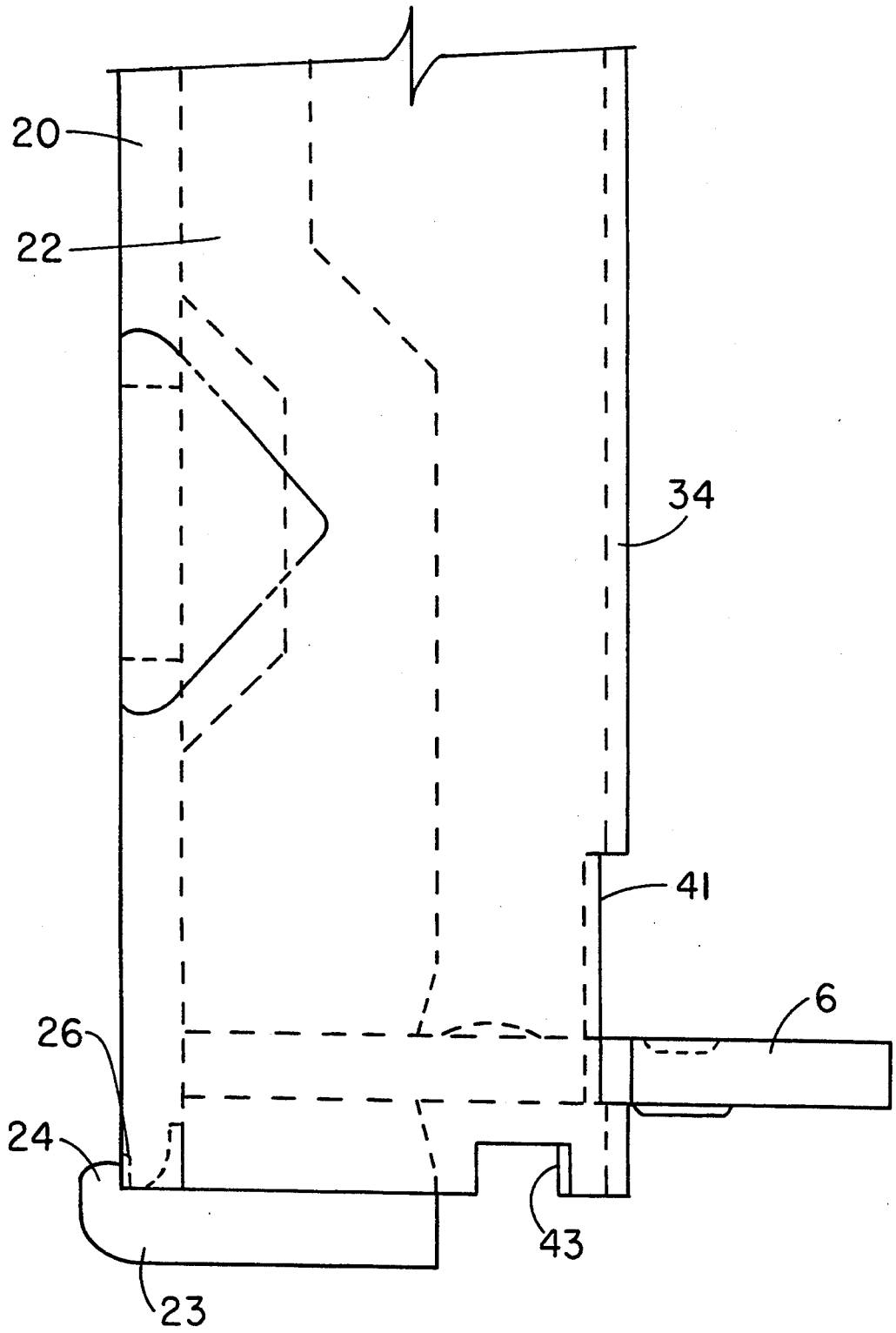
FIG. 6 is a further detail of an end of the tank sub-assembly.

The wall members termed hereafter baffles 6,8 comprise disc-shaped or plate-like elements. In order to hold these in position there is provided a guide or locating rail 22 in the form of a thin elongate member. This locating rail 22 is of substantially identical length to the header part 18 and tank part 20. The locating rail 22 as best seen in FIG. 6 is provided at opposite ends thereof with projecting lugs or feet 23 having upturned end portions 24. The feet 23 extend over the ends of the tank part 20, and are shaped so as to fit into slots or notches 26 cut into the ends of the tank part 20. The form of the locating rail 22 and the material used for the rail are such that the rail has a degree of resilience, whereby the upturned portions 24 snap-fit into the slots 26. The locating rail 22 is itself formed with slots 28 which are formed in regions of the rail 30 which are of increased thickness. Slots 32 are provided in each of the baffles. The slots 28 receive the baffles 6,8 with the slots 32 engaging with the slots 28 of the locating rail 22. Various additional kinks are provided in the locating rail to provide clearance for the attachment of inlet/outlet bosses to the tank part 20.

As an alternative, the locating rail 22 may be formed from two separate upper and lower sub-rails each carrying one end baffle 6 and intermediate baffle 8.

As best seen in FIG. 4 or 5, the header part 18 is of a larger radius than the tank part 20, so that edge regions 34 of the tank part 20 are received within the open side of the channel-shaped header part 18. The difference in radius is arranged so that the radius of the header part 18 is greater than that of the tank part 20 by very slightly less than the thickness of the wall of the tank part 20, thereby providing a degree of interference fit between the tank part 20 and header part 18, with an outer surface 36 of the edge region 34 engaging an inner surface 38 of an edge region 40 of the header part 18. It is also arranged that the tank part 20, in transverse section, in fact extends through a part circle which is greater than a true semi-circle. In FIG. 4 the angle subtended by the tank part 20 is in the region of 220° thereby providing a significant degree of overlap between the engaged edge surfaces 36 and 38. The baffles 6,8 are appropriately shaped to fit in transverse relation within the space between the assembled header part 18 and tank part 20, having a peripheral surface including two generally semi-circular regions of different radius. Notches 41 are cut in longitudinal edge regions 34 of the tank part to receive a region 42 on the baffles 6,8 which is a step between the two semi-circular regions of the baffles. These notches 41 provide control edges which assist in limiting twisting of the baffles on assembly.

Opposite ends of the tank part 20 are formed with notches 43 adjacent the edges of the tank part which receive alignment tabs 44 formed on the opposite ends of the header part 18, which arrangement serves to assist in ensuring correct relative alignment of the header and tank parts.

Various materials may be used for constructing the above components, such as for example copper, lead, aluminium or steel. In this case the tank and header parts are pressed from flat sheets and subsequently formed by machining to give the final shape with the required apertures, and notches. Alternatively, plastics materials may also be used.

The heat exchanger 2 is assembled in the following manner. A tank sub-assembly comprising tank part 20, locating rail 22 and end baffles 6 and intermediate baffles 8 is formed by locating the baffles 6,8 in the slots 28 in the locating rail 22, and fitting the locating rail 22 into the open side of the channel of the tank part 20 so that the projecting lugs 24 snap-fit into the slots 26 in the tank part 20. The locating rail 22 may alternatively be fitted on the tank part 20 before or at the same time as the baffles are fitted. Separately, the end portions of the heat exchange tubes 12 are entered into respective elongate apertures 10, the depth of insertion into these apertures 10 being set by means of a depth gauge. The apertures 10 may be very slightly smaller than the ends of the heat exchange tubes so that an interference fit results. The tank sub-assembly and header sub-assembly are then joined by bringing these together so that the open sides of the channels are facing each other, and the edge region 34 of the tank part 20 is received within the open side of the header part 18, with the surfaces 36 and 38 in engagement. The alignment tabs 44 at the ends of the header part 18 are then bent to fit into the notches 43 at the ends of the tank part 20, thereby ensuring correct relative positioning. At the opposite side of the heat exchange core 5 a similar manifold may be attached in the same manner. The manifold, and in particular the surfaces of the header 18 and tank 20, heat exchange tubes 12 and baffles 6,8 which are in engagement when assembled are provided with a cladding in the form of a fusible flux-containing metallic coating, prior to assembly of the sub-assemblies. After complete assembly, the heat exchanger is placed in an oven at, for example, 900° to braze the components in place, providing a pressure-tight arrangement.

If the tank and header parts are of plastics, instead of providing a fusible coating, alternative securing means may be provided.

What I claim is:

1. A heat exchanger manifold comprising:

a tubular housing having a header part in the form of an elongate member defining a plurality of apertures therein at which end portions of heat exchange tubes are connectable, and a tank part having an elongate member which is non-unitarily formed with said header part, which cooperates to define a tubular housing with said header part and is joined thereto at longitudinal engagement surfaces of the tank and header parts;

a plurality of wall members dimensioned to fit transversely within said housing;

an elongate locating said fitted within said tubular housing and supporting said wall members in said transverse relation within said tubular housing;

wherein said locating rail is adapted to snap-fit onto said tank part.

2. A heat exchanger manifold according to claim 1 wherein said locating rail is formed at opposite ends with laterally extending feet having upturned end portions extending therefrom which snap-fit over opposite ends of the tank part.

3. A heat exchanger manifold according to claim 2 wherein said tank part defines at opposite ends thereof notches into which the feet of the locating rail are received.

* * * * *